US012037083B1

(12) United States Patent
McDonald

(10) Patent No.: US 12,037,083 B1
(45) Date of Patent: Jul. 16, 2024

(54) WATERCRAFT PLANING HULL WITH INVERTED CHINE

(71) Applicant: Christian A. McDonald, Fredericksburg, TX (US)

(72) Inventor: Christian A. McDonald, Fredericksburg, TX (US)

(73) Assignee: Christian A. McDonald, Fredericksburg, TX (US)

( * ) Notice: Subject to any disclaimer, the term of this patent is extended or adjusted under 35 U.S.C. 154(b) by 0 days.

(21) Appl. No.: 18/461,485

(22) Filed: Sep. 5, 2023

(51) Int. Cl.

| | |
|---|---|
| ***B63B 1/20*** | (2006.01) |
| ***B63B 1/04*** | (2006.01) |
| ***B63B 1/06*** | (2006.01) |
| ***B63B 1/08*** | (2006.01) |
| ***B63B 1/18*** | (2006.01) |

(52) U.S. Cl.
CPC ..... *B63B 1/20* (2013.01); *B63B 1/04* (2013.01); *B63B 1/042* (2013.01); *B63B 1/06* (2013.01); *B63B 1/08* (2013.01); *B63B 1/18* (2013.01); *B63B 2001/201* (2013.01); *B63B 2001/202* (2013.01); *B63B 2001/203* (2013.01); *B63B 2241/20* (2013.01)

(58) Field of Classification Search
CPC ..... B63B 1/042; B63B 1/06; B63B 1/063; B63B 1/08; B63B 1/18; B63B 1/20; B63B 2001/201; B63B 2001/202; B63B 2001/203; B63B 2001/204; B63B 2241/20
USPC .... D12/300, 303, 310–314; 114/61.2, 61.27, 114/61.29, 61.3, 61.32, 61.33
See application file for complete search history.

(56) References Cited

U.S. PATENT DOCUMENTS

| | | | | |
|---|---|---|---|---|
| 3,067,711 | A * | 12/1962 | Hesher | B63B 1/20 D12/312 |
| 3,239,856 | A * | 3/1966 | Stocking | B63B 5/24 114/357 |
| D214,102 | S * | 5/1969 | Rae | D12/311 |
| 3,469,549 | A * | 9/1969 | Rae | B63B 1/20 114/291 |
| 3,625,173 | A | 12/1971 | Mitton | |
| 4,348,972 | A * | 9/1982 | Parsons | B63B 1/042 114/361 |
| 4,924,797 | A * | 5/1990 | Solia | B63B 1/20 114/291 |
| 5,038,696 | A * | 8/1991 | Athanasiou | B63B 1/20 114/291 |

(Continued)

OTHER PUBLICATIONS

Dan Spurr, Unsinkable: The History of Boston Whaler, Professional Boatbuilder Magazine, Mar. 26, 2019, https://www.proboat.com/2019/03/unsinkable-the-history-of-boston-whaler/, 6 pages.

(Continued)

*Primary Examiner* — Ajay Vasudeva
(74) *Attorney, Agent, or Firm* — Pillsbury Winthrop Shaw Pittman, LLP

(57) ABSTRACT

Provided is watercraft hull system, including a hull having a fore end, an aft end, and a longitudinal axis extending between the fore end and the aft end; a substantially V-shaped portion extending from the fore end toward the aft end along a portion of the longitudinal axis; and a substantially M-shaped portion extending from the V-shaped portion toward the aft end, wherein the V-shaped portion gradually transitions to the M-shaped portion.

20 Claims, 7 Drawing Sheets

(56) References Cited

U.S. PATENT DOCUMENTS

| | | | | |
|---|---|---|---|---|
| 5,125,352 | A * | 6/1992 | Shields | B63B 1/04 114/61.33 |
| D337,302 | S * | 7/1993 | Van Lancker | D12/314 |
| 5,265,554 | A | 11/1993 | Meredith | |
| 6,138,602 | A | 10/2000 | Cary | |
| 6,216,622 | B1 | 4/2001 | Lindstrom et al. | |
| 6,250,245 | B1 | 6/2001 | Robinson et al. | |
| 9,038,561 | B2 | 5/2015 | Loui et al. | |
| 9,517,813 | B2 | 12/2016 | Hotary et al. | |
| 10,293,886 | B2 * | 5/2019 | Bjersten | B63B 1/18 |
| 2004/0129192 | A1 | 7/2004 | Guerard | |

OTHER PUBLICATIONS

Aspen Carbon Cat, 2023, https://aspencarboncat.com/, 1 page.
Advanced Sailing Technologies GmbH, Beach-340, 2021, https://ast-yachts.com/beach-340/, 1 page.

* cited by examiner

WATERCRAFT PLANING HULL WITH INVERTED CHINE

BACKGROUND

1. Field

The present disclosure relates generally to watercraft hulls and more specifically to a hybrid V-shaped hull with an inverted chine.

2. Description of the Related Art

Planing hulls are ubiquitous in the marine industry. While the design and configuration of such hulls varies widely, many are designed to primarily utilize the effects of hydrodynamic lift generated by the hull's geometry at speed to support the vessel's weight. This allows planing hull vessels to "skim" atop the water "on plane", permitting faster speeds when compared with similarly powered and sized displacement hull vessels. However, as navigable bodies of water are rarely absent of waves, it is advantageous for the running surfaces of a hull to meet the water surface at an angle (e.g., deadrise angle: angle between flat plane (water surface) and hull running surface). This induces a dampening effect that mitigates pitching and rapid vertical deceleration (commonly referred to as "slamming") and generally provides a smoother, faster, and safer (more "seaworthy") ride when compared to hulls with a predominantly flat bottom or low deadrise angles. Planing hulls with a distinctively angled, wedge-shaped running surface are commonly called "deep-vee" hulls, in reference to their "V" shaped transverse cross section.

SUMMARY

The following is a non-exhaustive listing of some aspects of the present techniques. These and other aspects are described in the following disclosure.

Some aspects include a watercraft hull system, comprising: a hull having a fore end, an aft end, and a longitudinal axis extending between the fore end and the aft end; a V-shaped portion extending from the fore end toward the aft end along a portion of the longitudinal axis; and an M-shaped portion extending from the V-shaped portion toward the aft end, wherein the V-shaped portion gradually transitions to the M-shaped portion.

BRIEF DESCRIPTION OF THE DRAWINGS

The above-mentioned aspects and other aspects of the present techniques will be better understood when the present application is read in view of the following figures in which like numbers indicate similar or identical elements.

Figure 1A:
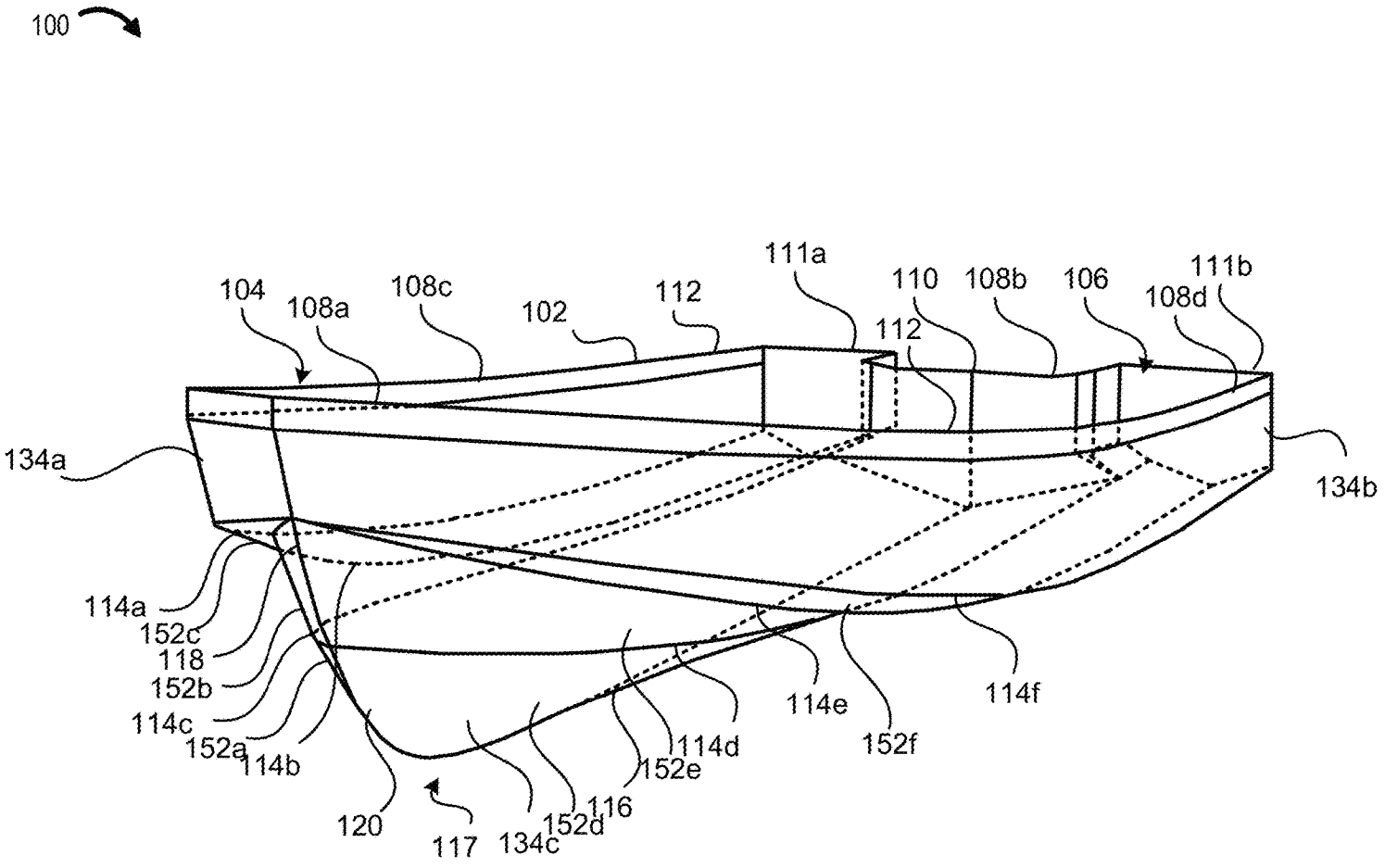
FIG. 1A illustrates a front perspective view of watercraft hull included in a watercraft hull system, in accordance with some embodiments of the present disclosure.
Figure 1B:
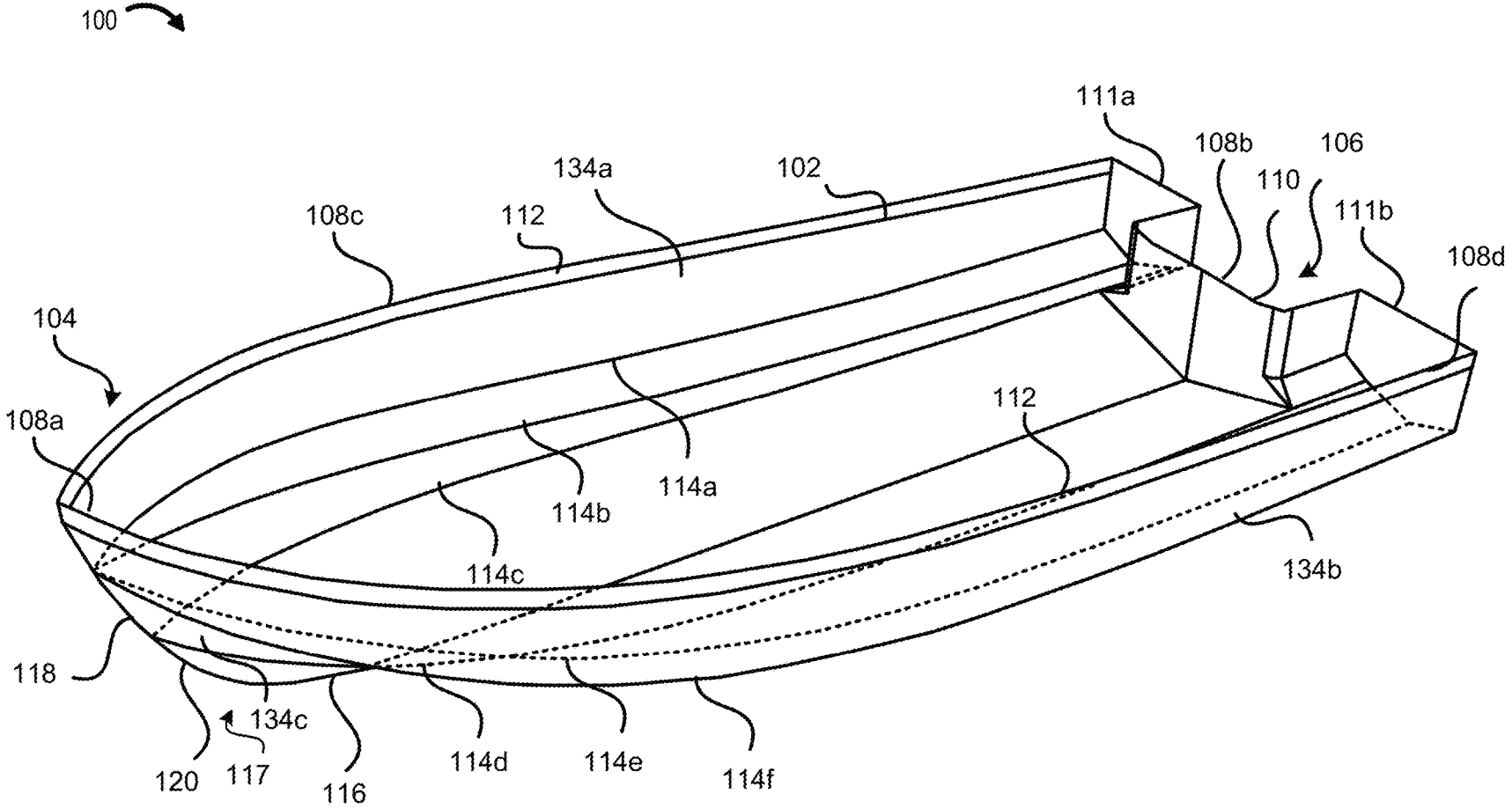
FIG. 1B illustrates a top perspective view of watercraft hull included in a watercraft hull system, in accordance with some embodiments of the present disclosure.
Figure 1C:
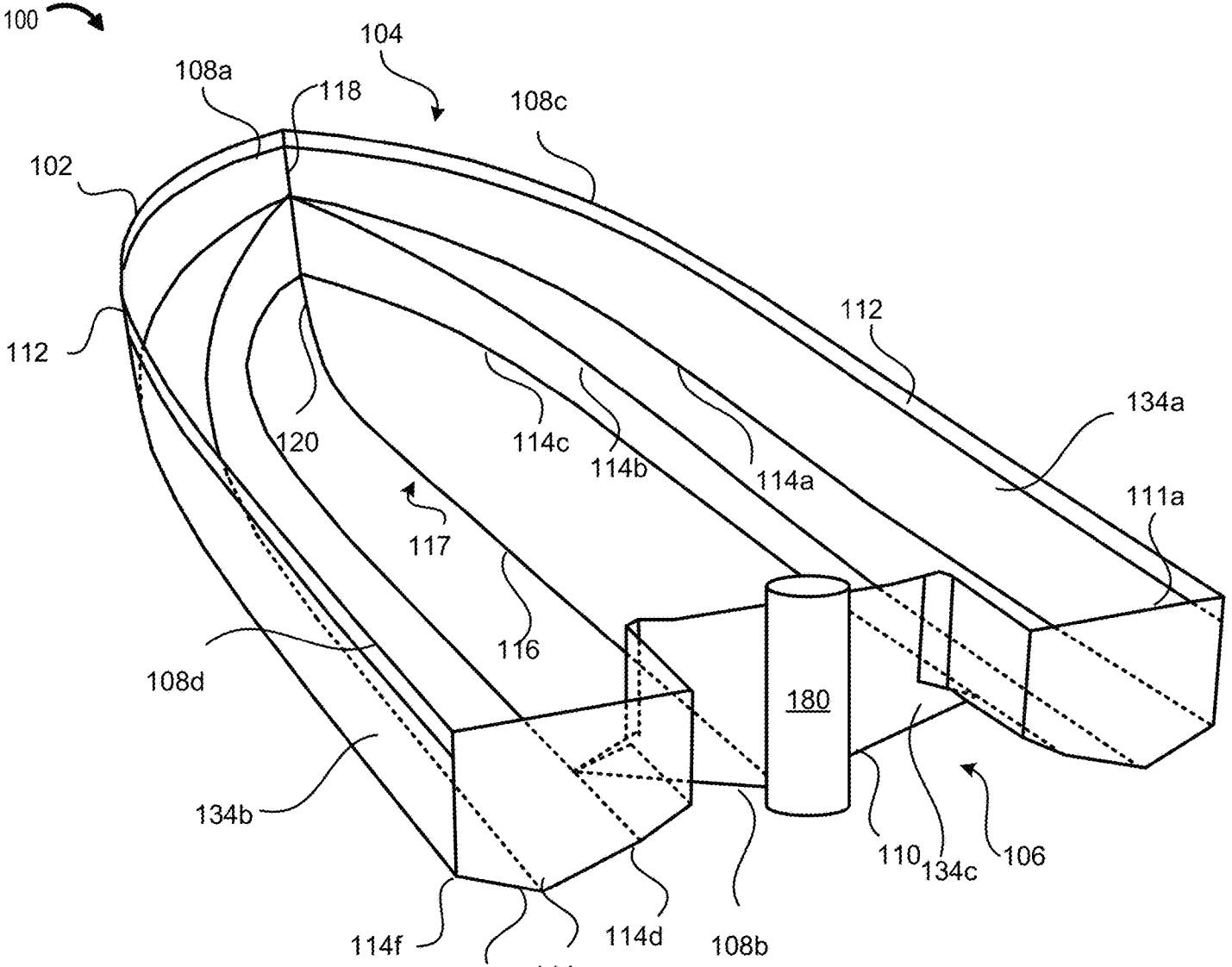
FIG. 1C illustrates a back perspective view of watercraft hull included in a watercraft hull system, in accordance with some embodiments of the present disclosure.

While the present techniques are susceptible to various modifications and alternative forms, specific embodiments thereof are shown by way of example in the drawings and will herein be described in detail. The drawings may not be to scale. It should be understood, however, that the drawings and detailed description thereto are not intended to limit the present techniques to the particular form disclosed, but to the contrary, the intention is to cover all modifications, equivalents, and alternatives falling within the spirit and scope of the present techniques as defined by the appended claims.

DETAILED DESCRIPTION OF CERTAIN EMBODIMENTS

To mitigate the problems described herein, the inventor had to both invent solutions and, in some cases just as importantly, recognize problems overlooked (or not yet foreseen) by others in the field of watercraft hulls. Indeed, the inventor wishes to emphasize the difficulty of recognizing those problems that are nascent and will become much more apparent in the future should trends in the industry continue as the inventor expects. Further, because multiple problems are addressed, it should be understood that some embodiments are problem-specific, and not all embodiments address every problem with traditional systems described herein or provide every benefit described herein. That said, improvements that solve various permutations of these problems are described below.

As discussed above, planing hulls of watercraft may include a wedge-shaped running surface or "V" shaped hull to provide a smoother ride when navigating through a fluid such as water. However, one drawback of this type of design can be a relative lack of stability when stationary or below planing speeds. Due to the nature of its "V" shaped cross section, when inclined/tilted to one side, the displacement, and thus buoyancy, on the side of the direction of inclination does not increase as quickly as comparable hulls with a flat bottom, "shallow-vee", or multihulls (such as catamarans and trimarans). Therefore, the leverage opposing the inclination of the vessel, or "righting moment", can be less than that of comparable hulls, resulting in decreased stability. This phenomenon can be particularly pronounced in smaller vessels, where the payload is a more significant percentage of the vessel's total weight, or in many cases, exceeds the empty weight of the vessel itself. In the case of passengers, the vessel's center of mass can be constantly moving or changing, and can create precarious scenarios such as when boarding or deboarding.

One way in which stability can be improved is by creating a watercraft with multiple hulls, such as a catamaran (two hulls) or trimaran (three hulls). However, this configuration also introduces new drawbacks. This includes a reduced amount of usable volume aboard the vessel, as the structure between the hulls (often referred to as the bridgedeck) must be of sufficient clearance above the water, which can be an especially challenging design complication for smaller vessels. Handling characteristics can also be significantly different from that of a traditional monohull.

A hybridized version of a deep-vee monohull and multihull emerged in the middle of the 20$^{th}$ Century in the form of a "cathedral hull" or "trihull". These vessels typically have an "M" shaped transverse cross section and somewhat rectangular plan when viewed from above. While such designs are intended to improve the stability of "deep-vee" monohulls by utilizing the same principal as trimarans, as well as retain the practicality and internal volume of more traditional monohulls, they often fall short with regard to comfort and seaworthiness. The concave sections between the "vees" are often carried the entire length forward, resulting in a bow characterized by a somewhat "boxy" appearance with low (or negative) deadrise angles that "slam" the water surface when encountering large waves. Thus, in an effort to improve the static stability of the deep-vee hull, such designs have partially lost the original dynamic benefit of the deep-vee hull and its ability to dampen the impact of waves and provide a smoother, safer ride.

Embodiments of the present disclosure provide a watercraft hull intended to more completely realize the dynamic seaworthiness characteristics of deep-vee monohull designs and the stability benefits of cathedral/trihull designs, while minimizing the inherent disadvantages in both. As such, the watercraft hull of the present disclosure provides a deep-vee planing hull form which seamlessly transitions rearwardly from a "V" shaped cross section into an "M" shaped cross section.

The aft sections (~60% of the length of the specific watercraft hull) are similar in form to a cathedral hull/trihull design, with concave regions of negative deadrise. The forward sections (~40% of the specific boat's length as described in the present disclosure) are exclusively positive deadrise, similar in form to a traditional deep-vee hull design. This allows the forward section of the vessel to more efficiently "slice" the waves, while the rear section can provide more stability. The transition between positive deadrise and negative deadrise is seamless and without notable boundary. In specific embodiments, three chines on each side of the watercraft originate/terminate at the bow stem of the watercraft hull, not at the sheer (e.g., the longitudinal deck curve/line at the "top" of the watercraft hull), which differentiates the watercraft hull of the present disclosure from existing cathedral hull designs. Again, the watercraft hull of the present disclosure provides a transition between exclusively positive deadrise forward, to areas of negative deadrise aft, where the regions of negative deadrise are significantly less than 90 degrees. Some vessels, including some cathedral hulls, have regions of negative deadrise nearly perpendicular to the waterline. This can create undesirable and unsafe handling characteristics when turning.

Referring now to FIGS. 1A, 1B, 1C, 1D, 1E, and 1F an embodiment of a watercraft hull system 100 is illustrated. The watercraft hull system 100 may include a watercraft hull 102. The watercraft hull 102 may be included on a variety of watercraft such as a boat, a ship, a personal watercraft, a submersible, a seaplane, or other watercraft or vessels that would be apparent to one of skill in the art in possession of the present disclosure. As illustrated, the watercraft hull 102 may be constructed of one continuous piece. For example, the watercraft hull 102 may be molded. However, in other embodiments, the watercraft hull 102 may be constructed of individual components that are secured together. In any case, the watercraft hull 102 may include a bow 104 (e.g., the "front" portion of the watercraft hull 102) and a stern 106 (e.g., the "rear" portion of the watercraft hull 102). Similarly, the watercraft hull 102 includes a fore or forward 108*a* (e.g., referring to the front part, forward direction, or forward end of the watercraft hull 102), an aft 108*b* (e.g., referring to the rear part, in the rearward direction, or rearward end of the watercraft hull 102), a starboard side 108*c* (e.g., referring to the righthand side of the watercraft hull 102 when facing toward the bow 104), and a port side 108*d* (e.g., referring to the lefthand side of the watercraft hull 102 when facing toward the bow 104).

In various embodiments, the watercraft hull 102 includes a transom 110. Conventionally, a transom may include a generally flat or planar, vertical section of the watercraft hull 102 that forms the rear, joining the sides and bottom of the watercraft hull 102, and frequently deck as well. On watercraft that are powered by one or multiple outboard motors 180, the transom 110 is where the outboard motor 180 would normally be affixed, and is reinforced for this purpose. While the transom usually spans the entire width of the vessel at its rearmost point, the embodiment of the present disclosure provides the transom 110 as only the middle of the three flat vertical aft sections, which include a vertical aft section 111*a* and a vertical aft section 111*b*, as the transom 110 is where any outboard motor may be affixed. The vertical aft sections 111*a* and 111*b* may be the furthest part of the stern 106 from the bow 104 and further from the bow 104 than the transom 110. In some embodiments, the vertical aft section 111*a* and 111*b* may be optional such that only the transom 110 exists.

In various embodiments, the watercraft hull 102 may include a sheerline 112 that forms a top edge of the watercraft hull 102, where the watercraft hull 102 would meet a deck. The watercraft hull 102 also includes a plurality of chines 114. A chine may include an abrupt change in cross-sectional angle in the watercraft hull 102. In the illustrated embodiment, the watercraft hull 102 includes a chine 114*a*, a chine 114*b*, and a chine 114*c* on the starboard side 108*c* (also referred to herein as starboard chines 114*a*, 114*b*, and 114*c*). The watercraft hull 102 includes a chine 114*d*, a chine 114*e*, and a chine 114*f* on the port side 108*d* (also referred to herein as port chines 114*d*, 114*e*, and 114*f*). The chine 114*a* corresponds with the chine 114*f*, the chine 114*b* corresponds with chine 114*e*, and the chine 114*c* corresponds with the chine 114*d*. When viewed in profile, a chine may be interpreted as a line and crease in a geometry of the watercraft hull 102. For example, in a common planing hull, there is one chine on either side of the planing hull, running fore-and-aft, where sides of the planing hull meet the bottom of the planing hull.

In various embodiments, the watercraft hull 102 may include a keel 116. The keel, in conventional watercraft, provides structure to the watercraft, extends longitudinally along the center (e.g., a longitudinal axis) of the bottom and may project from the bottom of the watercraft. The keel 116 that is included in the watercraft hull 102 of the present disclosure may not project from the bottom of the watercraft hull 102. Rather, the watercraft hull 102 may be a monocoque molded component of which the keel 116 is indistinguishable and merely forms a central "crease" along a centerline 117 of the watercraft hull 102. As such, because the keel 116 may be a "crease" along the centerline 117 of the watercraft hull 102, the keel 116 may be considered a chine as well. Furthermore, in some embodiments. a very shallow keel called a "skeg" could form the keel 116.

In various embodiments, the watercraft hull 102 may include a stem 118. Traditionally, a stem is the vertical timber or structural component at the bow of the watercraft. The stem 118 of the present disclosure may refer to the more vertical section of the centerline of the watercraft hull 102, which may be an extension of the keel 116 at the fore 108*a* of the watercraft hull 102. A forefoot 120 may reference a bend along the centerline of the watercraft hull 102 that forms the transition between the keel 116 and the stem 118.

Figure 1D:
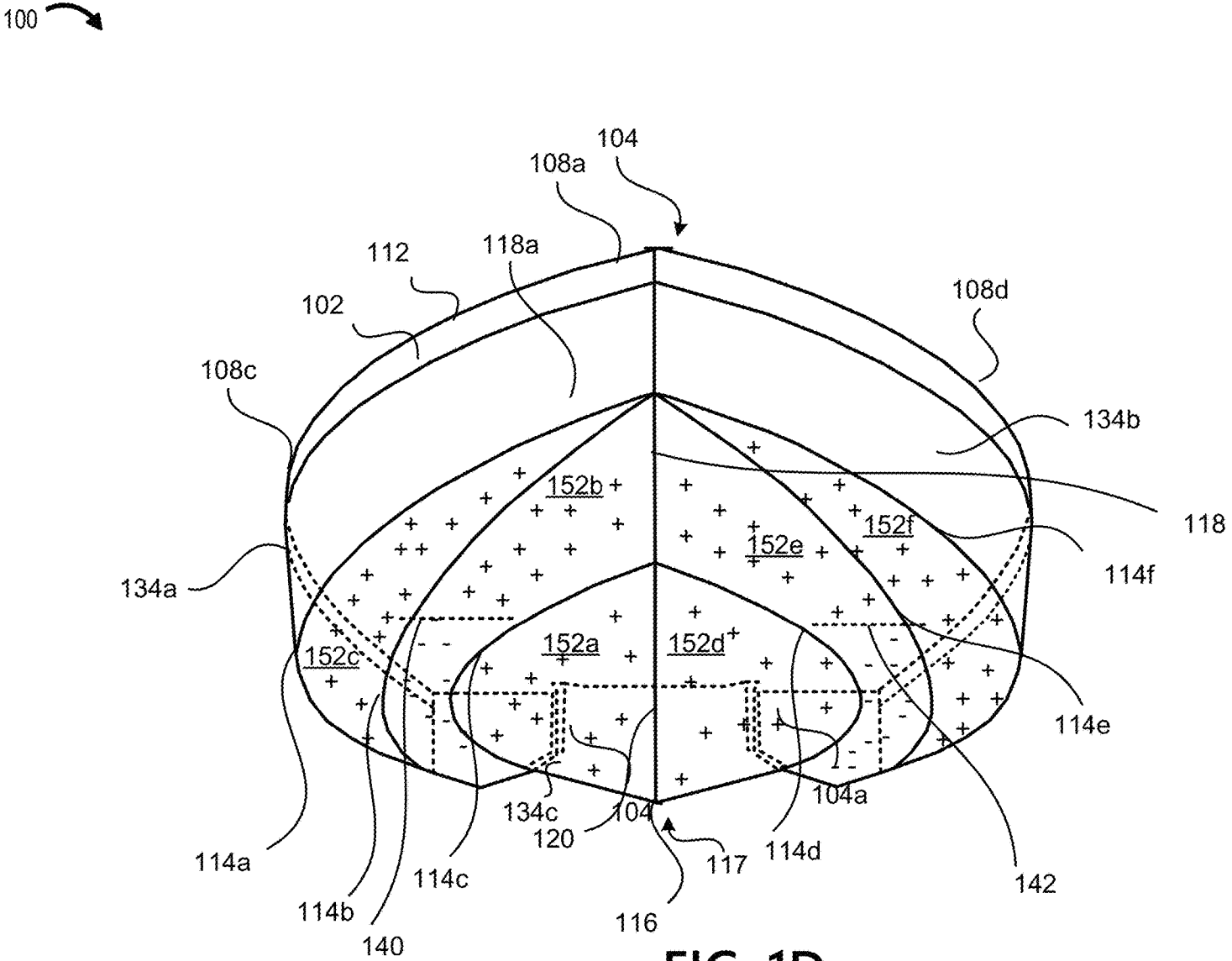
FIG. 1D illustrates a front view of watercraft hull included in a watercraft hull system, in accordance with some embodiments of the present disclosure.
Figure 1E:
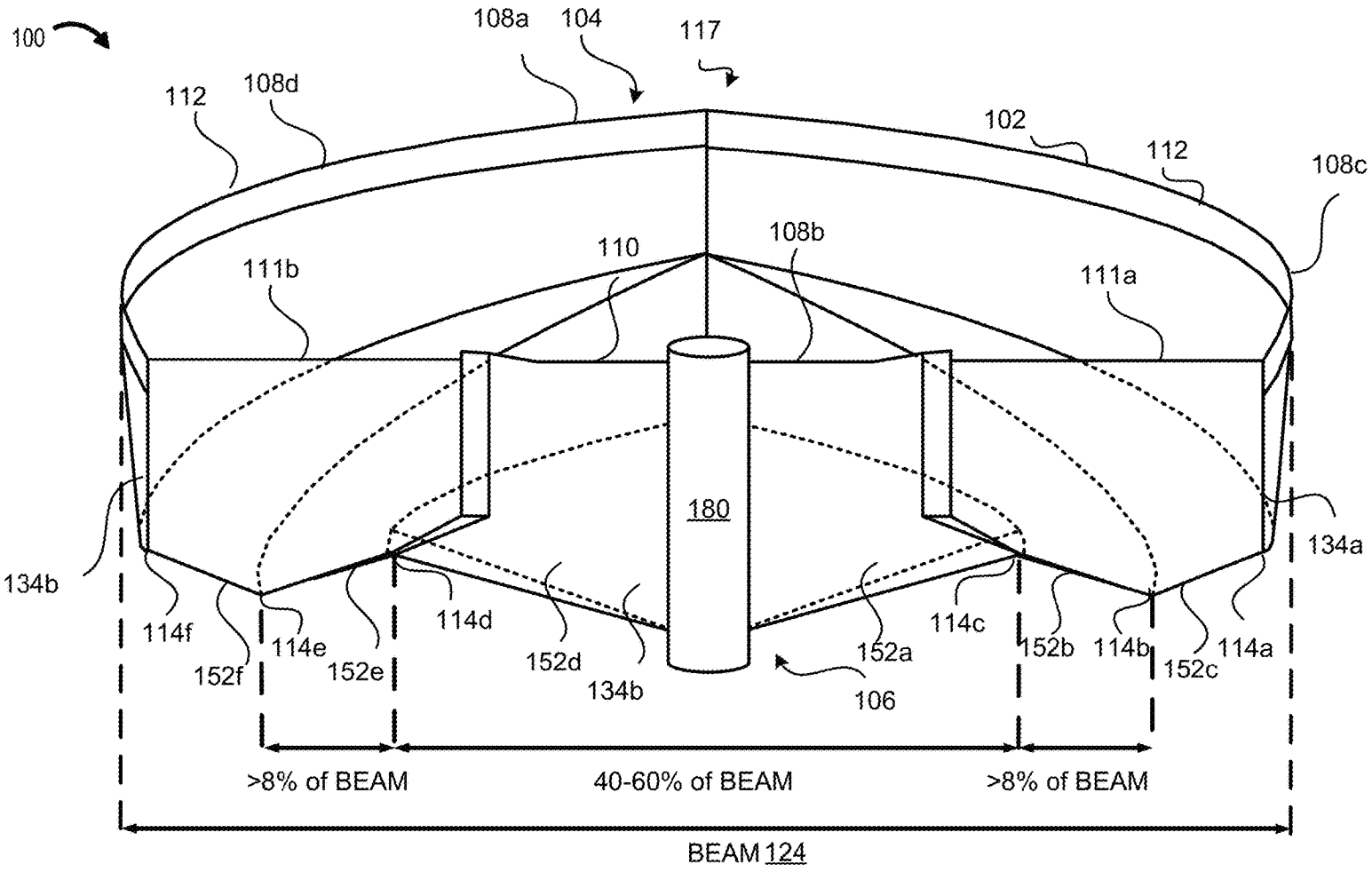
FIG. 1E illustrates a rear view of watercraft hull included in a watercraft hull system, in accordance with some embodiments of the present disclosure.
Figure 1F:
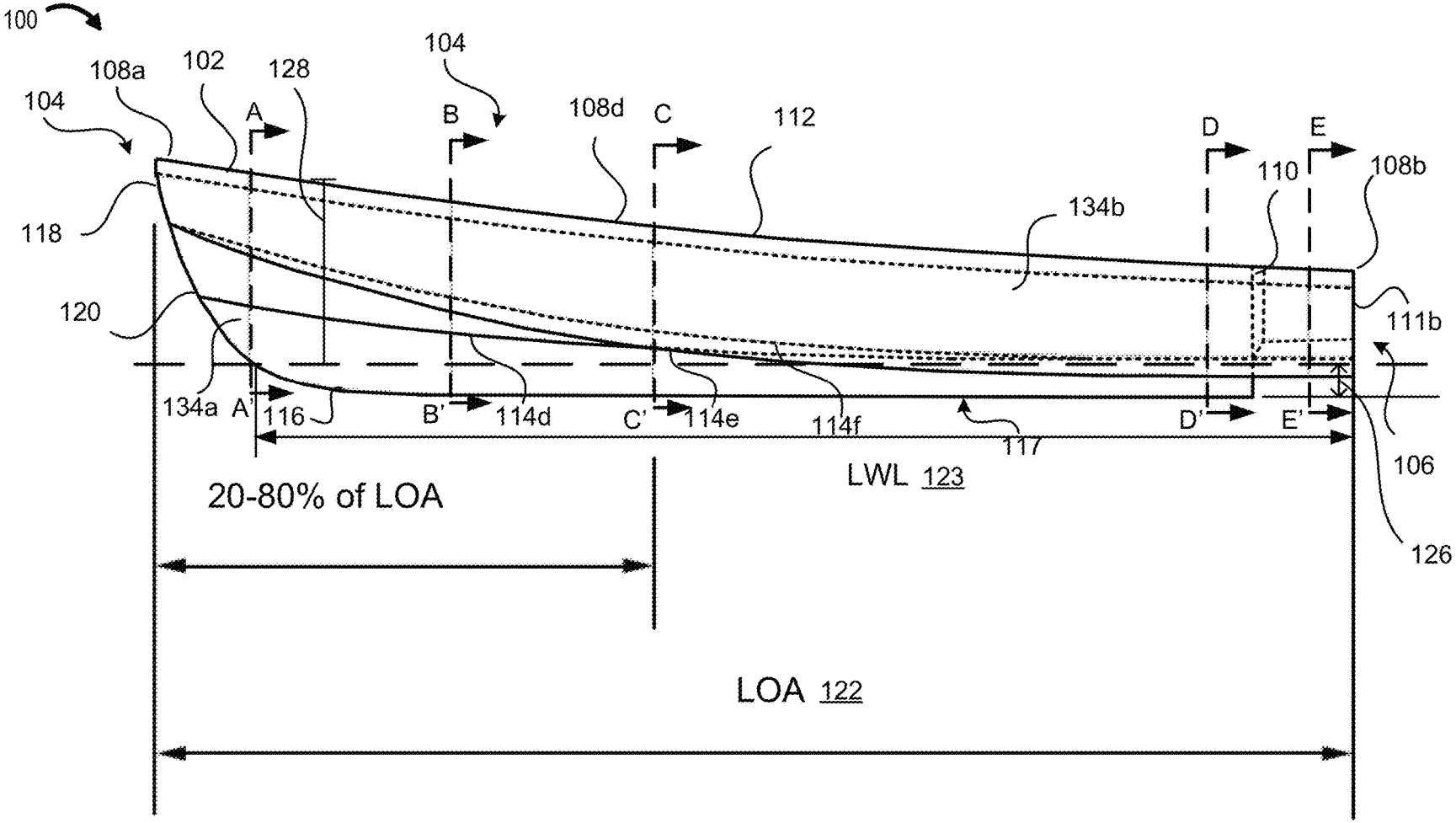
FIG. 1F illustrates a side/port view of watercraft hull included in a watercraft hull system, in accordance with some embodiments of the present disclosure.

To describe the shape, dimensions, and other physical attributes of the watercraft hull 102 several terms of art are used herein and referenced in FIGS. 1E and 1F. For example, the watercraft hull 102 may be described with reference to its length over all (LOA) 122 which may include the total length of the watercraft hull 102 from the furthest point forward at 108*a* of the bow 104 to the furthest point aft 108*b* at the stern 106. The term length water line (LWL) 123 is the total length of the watercraft hull 102 where the watercraft hull 102 intersects the waterline. The LWL 123 can change significantly, especially with smaller watercraft hulls due to loading and balance. A beam 124 may reference the widest part of the watercraft hull 102 that has the greatest distances between the starboard side 108*c* and the port side 108*d*. A draft 126 may reference the distance from the waterline to the deepest point of the watercraft hull 102. The draft 126 may also be known as "depth." The freeboard 128 may reference the distance from the waterline to the sheerline 112 at any given point. Displacement may be equivalent to the weight of the watercraft hull 102 and its payload.

Deadrise may be an angle of a running surface relative to a line parallel to the waterline of the watercraft hull 102 (facing outward from the centerline of the watercraft hull 102). A deadrise angle of 0 degrees would be flat, parallel to the water surface; 90 degrees would be perpendicular to the water surface. A positive deadrise angle would indicate that the surface is angled outward away from the centerline. A negative deadrise angle would indicate the surface is angled inward toward the centerline. The deadrise of the watercraft hull 102 and chines 114*a*-114*f* are discussed in further detail below.

In some embodiments, the watercraft hull 102 may include a sponson 134*a* on the starboard side 108*c* and a sponson 134*b* on the port side 108*d*. The term sponson used herein may describe the minor hull portions making up the starboard side 108*c* and the port side 108*d* of the watercraft hull. Typical sponsons are projections form the side of a watercraft hull such as in a rigid inflatable boat (RIB). For example, sponsons may include inflatable tubes that are used to provide buoyancy and improved stability. Conventional sponsons are very pronounced and visibly distinct from the rest of the hull. The sponsons 134*a* and 134*b* of the present disclosure broadly describes the geometrically and materially seamless transition of these minor hull portions from a main portion 134*c* of the watercraft hull 102.

As discussed above, the watercraft hull 102 of the present disclosure provides a hybrid deep-vee planing hull form which seamlessly transitions rearwardly from a "V" shaped cross section into an "M" shaped cross section. As such, there is a seamless transition from a positive deadrise at the bow 104 of the watercraft hull 102 to a negative deadrise to the stern 106 of the watercraft hull 102. FIG. 1D, illustrates the transition point from sections with exclusively positive deadrise "+", to sections with an area of negative deadrise "−". This is indicated by a crossover 140 and 142 between the lower two chines, as marked by a dotted lines in FIG. 1D. Ideally, this transition may occur at a linear latitudinal distance from the bow 104 equivalent to between 20% to 80% of the total length (LOA 122) of the watercraft hull 102. As illustrated, in FIG. 1D, an area 152*a* (also referred to herein as a first starboard side hull area) and an area 152*d* (also referred to herein as a first port side hull area) of the watercraft hull 102 defined by the chine 114*c* and the keel 116 and the chine 114*d* and the keel 116, respectively, has a positive deadrise. As illustrated in FIG. 1E, this area that includes the area 152*a* and the area 152*d* may have a width of 40%-60% of the beam 124 at cross section D in FIG. 1E and FIG. 1F and the angle may range from 15° to 90°. The angles may range from 15 degrees (cross section D) to almost 90 degrees (at the stem), so as long as the angle is equal to or in excess of 15 degrees in that area at any cross section. It is also important to note that the 40%-60% of the beam, as mentioned above, is only valid in the aft sections (behind cross section C), because as one moves toward the bow, the percentage eventually becomes 0% of the beam where chine 114*c* and 114*d* converge.

An area 152*b* of the watercraft hull 102 defined by the chine 114*b* and the chine 114*c* (e.g., the area between chines 114*b* and 114*c* (also referred to herein as a second starboard side hull area)) and similarly an area 152*e* of the watercraft hull 102 defined by the chines 114*d* and the chines 114*e* (also referred to herein as a second port side hull area) may start with a positive deadrise at the bow 104 of the watercraft hull 102. This area that includes the area 152*b* and the area 152*e* may transition from having a positive deadrise to a negative deadrise at a distance from the bow 104 to the stern 106 of 20% of the LOA 122 up to 80% of the LOA 122. If the transition occurred forward of 20% of the LOA 122, the areas of negative deadrise and areas of relatively low deadrise just aft of the transition would be too far forward, resulting in an increased propensity to slam the water surface, particularly in rough sea conditions. Stated alternatively, areas of the forward sections of the watercraft hull 102 would not have the high deadrise angles needed and desired to effectively form a wedge shape and part the water with a dampening effect. Additionally, if the transition occurred aft of 80% of the LOA, the "sponsons" 134*a* and 134*b* would not be formed until much further aft, effectively lowering their volume and thus the wider distribution of buoyancy which affords the desired increased stability of the watercraft hull 102.

The portion of the area 152*b* of the watercraft hull 102 defined by the chine 114*b* and the chine 114*c* and the portion of the area 152*e* of the watercraft hull 102 defined by the chine 114*d* and the chine 114*e* having positive deadrise (e.g., the forward portion (forward of the crossover 140 and 142)) may have an angle range of greater than 0° to less than 90°. The angle may gradually decrease moving from the bow 104 to the stern 106 until the crossover 140 and 142 where the angle is 0 degrees. The deadrise then turns negative and gradually decreases until the deadrise is of a minimum angle of −10 to −60 degrees. This range allows for a compromise between static stability and dynamic handling characteristics. A negative angle less than 10 degrees (more parallel to water surface) would reduce the draft of the sponsons 134*a* and 134*b*, and thus their submerged volume and buoyancy, which could reduce the watercraft hull's overall stability. A negative angle greater than 60 degrees (more perpendicular to water surface) would result in less desirable (and potentially dangerous) handling characteristics. When turning the watercraft hull 102 at speed, negative deadrise angles within the range specified would permit the aft sections of the hull to "kick out", "skim", and "drift" atop the water during a turn. A negative angle greater than 60 degrees increases the likelihood of the aft sections of the watercraft hull 102 resisting the flow of water laterally across its geometry ("scooping" the water), reducing the maneuverability of the watercraft hull 102, and potentially causing the watercraft hull 102 to heel (lean) outward away from the direction of the turn, which can lead to a capsize.

At the maximum width of the hull or beam 124, the width of the area 152*b* of the watercraft hull 102 defined by the chines 114*b* and the chines 114*c* may range from 8%-25%. The beam 124 may be the point where the sponsons are fully formed. However, in other embodiments, the beam 124 may not be the point where the sponsons are fully formed. Similarly, the width of the area 152*e* of the watercraft hull 102 defined by the chines 114*d* and 114*e* may range from 8%-25%. Bound by areas of positive deadrise, the width of the area of negative deadrise on each side of the centerline should be in excess of 8% of the beam 124. Should this figure be less than 8% of the beam 124, either the buoyancy of the sponsons 134*a* or 134*b* may not be great enough to achieve the desired stability, or the angle of the negative deadrise may be too steep, or both.

In an embodiment, the portion of the area of the watercraft hull 102 defined by the chine 114*a* and the chine 114*b* (an area 152*c* that is also referred to herein as a third starboard side hull area) and the portion of the area of the watercraft hull 102 defined by the chine 114*f* and the chine 114*e* (an area 152*f* that is also referred to herein as a third port side hull area) may have a positive deadrise from bow 104 to stern 106. The deadrise may range from greater than 0° less than 90° along the LOA 122. The width of the area 152*c* of the watercraft hull 102 defined by the chines 114*a* and the chines 114*b* may range from 0%-25%. Similarly, the width of the area 152*f* of the watercraft hull 102 defined by the chines 114*f* and 114*e* may range from 0%-25%. The area of positive deadrise defined by chine 114*a* and chine 114*b* and the area of positive deadrise defined by chine 114*f* and chine 114*e* enhance maneuverability and handling characteristics by allowing the aft sections of the hull to lift and skim atop the water when turning on plane.

Figures 2A, 2B, 2C, 2D, 2E:
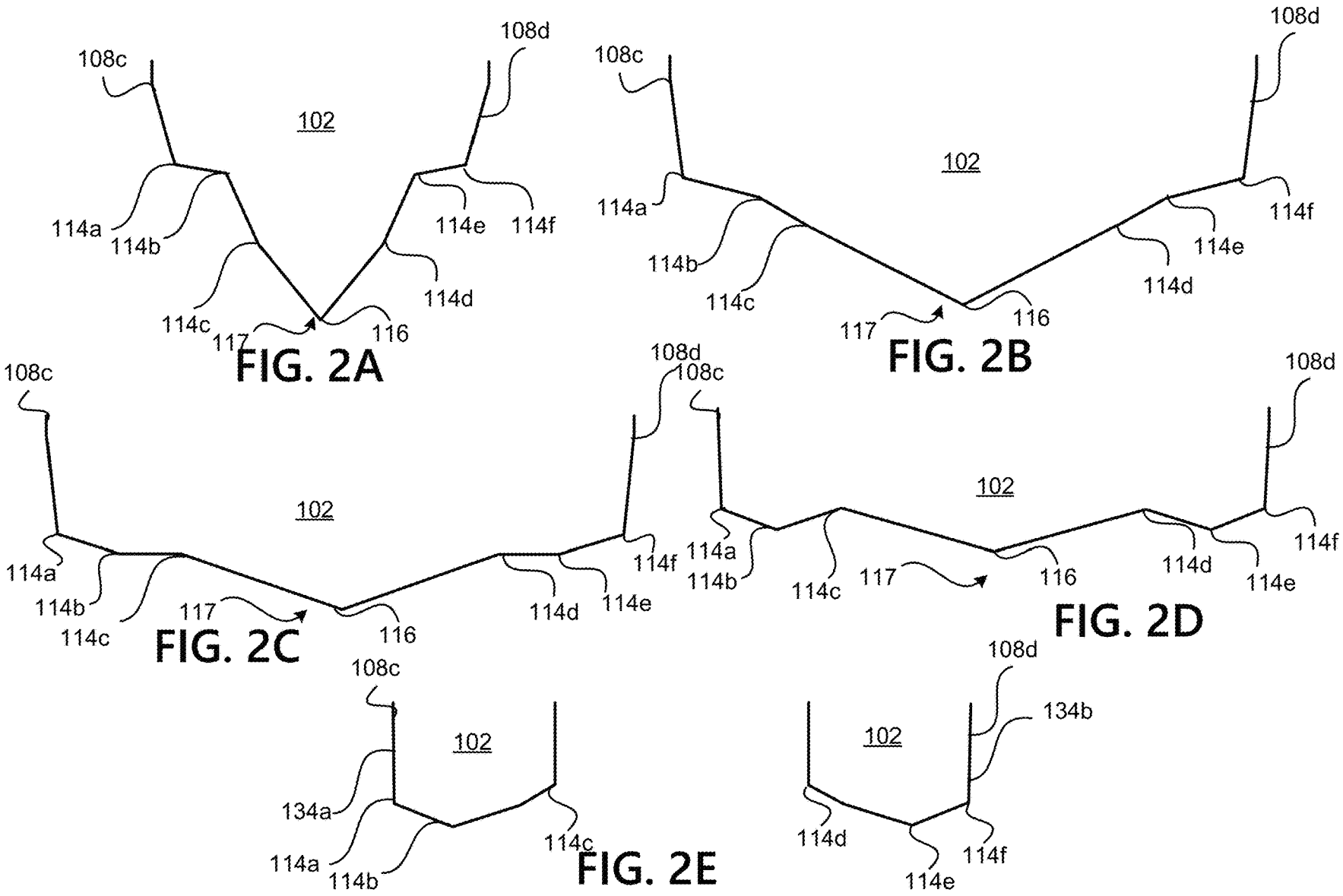
FIGS. 2A-2E illustrate various sectional views of the watercraft hull along planes A-A', B-B', C-C', D-D', and E-E', respectively, of FIG. 1F, in accordance with some embodiments of the present disclosure.

FIG. 2A illustrates a cross-sectional view of the watercraft hull 102 of FIG. 1F along plane A-A'. As illustrated by FIG. 2A, the areas of the watercraft hull 102 defined by the chine 114*a* and the chine 114*b*, defined by the chine 114*b* and the chine 114*c*, defined by the chine 114*c* and the keel 116, defined by the keel 116 and the chine 114*d*, defined by the chine 114*d* and the chine 114*e*, and defined by the chine 114*e* and the chine 114*f* may have a positive deadrise.

FIG. 2B illustrates a cross-sectional view of the watercraft hull 102 of FIG. 1F along plane B-B'. As illustrated by FIG. 2B, the areas of the watercraft hull 102 defined by the chine 114*a* and the chine 114*b*, defined by the chine 114*b* and the chine 114*c*, defined by the chine 114*c* and the keel 116, defined by the keel 116 and the chine 114*d*, defined by the chine 114*d* and the chine 114*e*, and defined by the chine 114*e* and the chine 114*f* may have a positive deadrise. The deadrise of the area of the watercraft hull 102 defined by the chine 114*c* and the keel 116 and defined by the keel 116 and the chine 114*d* may be less positive than in FIG. 2A. Similarly, the deadrise of the area of the watercraft hull 102 defined by the chine 114*b* and the chine 114*c* and defined by the chine 114*d* and the chine 114*e* may be less positive than in FIG. 2A and about the same deadrise (e.g. within 5 degrees) as the area of the watercraft hull 102 defined by the chine 114*c* and the keel 116 and defined by the keel 116 and the chine 114*d*. The area of the watercraft hull 102 defined by the chine 114*a* and the chine 114*b* and defined by the chine 114*e* and the chine 114*f* may be less positive than other areas and substantially similar (e.g., within 5 degrees) to the corresponding area in FIG. 2A.

FIG. 2C illustrates a cross-sectional view of the watercraft hull 102 of FIG. 1F along plane C-C'. This cross-sectional view illustrates the transition from a positive deadrise to a negative deadrise in the areas of the watercraft hull 102 defined by the chine 114*b* and the chine 114*c* and defined by the chine 114*d* and the chine 114*e*. As illustrated, this area may have a 0 degree deadrise. As such, FIG. 2C illustrates the cross-section of the watercraft hull 102 where it transitions from a "V" shaped hull (e.g., a dee-vee hull) into an "M" shaped hull (e.g., "cathedral hull" or "trihull").

FIG. 2D illustrates a cross-sectional view of the watercraft hull 102 of FIG. 1F along plane D-D'. This cross-sectional view illustrates the areas of the watercraft hull 102 defined by the chine 114*b* and the chine 114*c* and defined by the chine 114*d* and the chine 114*e* now having a negative deadrise. In some embodiments, that negative deadrise extends to the stern 106 of the watercraft hull 102. FIG. 2E illustrates a cross-sectional view of the watercraft hull 102 of FIG. 1F along plane E-E'. This cross-sectional view illustrates the sponsons 134*a* and 134*b* at the stern end of the watercraft hull 102 that extend past the transom 110. The area of the watercraft hull 134 defined by the chine 114*a* and the chine 114*b* and defined by the chine 114*e* and the chine 114*f* may have a positive deadrise. The area of the watercraft hull 134 defined by the chine 114*b* and the chine 114*c* and defined by the chine 114*d* and the chine 114*e* may have a negative deadrise.

Thus, the watercraft hull of the present disclosure provides a transition from a "V" shaped hull with all positive deadrise to an "M" shaped hull with at least one area on both sides of the watercraft hull having a negative deadrise between two areas on both sides of the watercraft hull having positive deadrise. This may be accomplished by inverting a chine. As such, the watercraft hull of the present disclosures provides dynamic seaworthiness characteristics of deep-vee monohull designs and the stability benefits of cathedral/trihull designs, while minimizing the inherent disadvantages in both. As such, the watercraft hull of the present disclosure provides a deep-vee planing hull form which seamlessly transitions rearwardly from a "V" shaped cross section into an "M" shaped cross section.

The reader should appreciate that the present application describes several independently useful techniques. Rather than separating those techniques into multiple isolated patent applications, the applicant has grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Similarly, reference to "a computer system" performing step A and "the computer system" performing step B can include the same computing device within the computer system performing both steps or different computing devices within the computer system performing steps A and B. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation. As is the case in ordinary usage in the field, data structures and formats described with reference to uses salient to a human need not be presented in a human-intelligible format to constitute the described data structure or format, e.g., text need not be rendered or even encoded in Unicode or ASCII to constitute text; images, maps, and data-visualizations need not be displayed or decoded to constitute images, maps, and data-visualizations, respectively; speech, music, and other audio need not be emitted through a speaker or decoded to constitute speech, music, or other audio, respectively. Computer implemented instructions, commands, and the like are not limited to executable code and can be implemented in the form of data that causes functionality to be invoked, e.g., in the form of arguments of a function or API call. To the extent bespoke noun phrases (and other coined terms) are used in the claims and lack a self-evident construction, the definition of such phrases may be recited in the claim itself, in which case, the use of such bespoke noun phrases should not be taken as invitation to impart additional limitations by looking to the specification or extrinsic evidence.

In this patent, to the extent any U.S. patents, U.S. patent applications, or other materials (e.g., articles) have been incorporated by reference, the text of such materials is only incorporated by reference to the extent that no conflict exists between such material and the statements and drawings set forth herein. In the event of such conflict, the text of the present document governs, and terms in this document should not be given a narrower reading in virtue of the way in which those terms are used in other materials incorporated by reference.

The present techniques will be better understood with reference to the following enumerated embodiments:

1. A watercraft hull system, comprising: a hull having a fore end, an aft end, and a longitudinal axis extending between the fore end and the aft end; a V-shaped portion extending from the fore end toward the aft end along a portion of the longitudinal axis; and an M-shaped portion extending from the V-shaped portion toward the aft end, wherein the V-shaped portion gradually transitions to the M-shaped portion.
2. The watercraft hull of embodiment 1, wherein the hull includes a first starboard chine, a second starboard chine, a third starboard chine, a first port chine that extends from the first starboard chine at a centerline that runs along the longitudinal axis, a second port chine that extends from the second starboard chine at the centerline, and a third port chine that extends from the third starboard chine at the centerline.
3. The watercraft hull of embodiment 2, wherein the centerline includes a keel having a stem and a forefoot.
4. The watercraft hull of embodiment 3, wherein the first port chine and the first starboard chine meet at a first point on the stem, wherein the second port chine and the second starboard chine meet at a second point on the stem above the first point, and the third port chine and the third starboard chine meet at a third point on the stem above the second point and is nearest a sheerline of the hull.
5. The watercraft hull of embodiment 4, wherein the second point and the third point are the same point.
6. The watercraft hull of any one of embodiments 2-4, wherein the first starboard chine and the centerline define a first starboard side hull area, the first port chine and the centerline define a first port side hull area, the second starboard chine and the first starboard chine define a second starboard side hull area that extends starboard from the first starboard side hull area, the second port chine and the first port chine define a second port side hull area that extends port from the first port side hull area, the third starboard chine and the second starboard chine define a third starboard side hull area that extends starboard from the second starboard side hull area, and the third port chine and the second port chine define a third port side hull area that extends port from the second port side hull area.
7. The watercraft hull of embodiment 6, wherein the second starboard side hull area is between the first starboard side hull area and the third starboard side hull area, and the second port side hull area is between the first port side hull area and the third port side hull area.
8. The watercraft hull of any one of embodiments 6 or 7, wherein the first starboard side hull area and the first port side hull area have positive deadrise from the fore end to the aft end.
9. The watercraft hull of any one of embodiments 6-8, wherein the third starboard side hull area and the third port side hull area have positive deadrise from the fore end to the aft end.
10. The watercraft hull of any one of embodiments 6-9, wherein the second starboard side hull area and the second port side hull area have positive deadrise in the V-shaped portion that gradually decreases in angle from the fore end to a zero degree angle at a furthest aft end of the V-shaped portion and have a negative deadrise in the M-shaped portion that gradually becomes more negative from the zero degree angle where the M-shaped portion is adjacent the V-shaped portion to a final negative angle.
11. The watercraft hull of embodiment 10, wherein the final negative angle is an angle between −10 degrees and −60 degrees.
12. The watercraft hull of any one of embodiments 10 or 11, wherein the final negative angle is realized at a point longitudinally in the M-shaped portion before the aft end and the second starboard side hull area and the second port side hull area continue from the point to the aft end substantially at the final negative angle.
13. The watercraft hull of any one of embodiments 10-12, wherein the second starboard side hull area and the third starboard side hull area in the M-shaped portion form a starboard sponson, and the second port side hull area and the third port side hull area in the M-shaped portion form a port sponson.
14. The watercraft hull of embodiment 13, wherein a transom extends substantially vertically from the first starboard side hull area and the first port side hull area at the aft end.
15. The watercraft hull of embodiment 14, wherein the starboard sponson and the port sponson end further aft than the transom.
16. The watercraft hull of any one of embodiments 10-15, wherein the second starboard side hull area and the third starboard side hull area in the V-shaped portion and the M-shaped portion form a starboard sponson, and the second port side hull area and the third port side hull area in the V-shaped portion and the M-shaped portion form a port sponson.
17. The watercraft hull of embodiment 6, wherein the second starboard side hull area has a latitudinal width of at least 8% of a beam of the hull in the M-shaped portion and the second port side hull area has a latitudinal width of at least 8% of the beam of the hull in the M-shaped portion.
18. The watercraft hull of embodiment 17, wherein the first starboard side hull area has a latitudinal width of 20%-30% of the beam of the hull in the M-shaped portion and the first port side hull area has a latitudinal width of at least 20%-30% of the beam of the hull in the M-shaped portion.
19. The watercraft hull of any one of embodiments 1-18, wherein the V-shaped portion gradually transitions to the M-shaped portion by inverting a chine.
20. A boat, comprising: a hull including a fore end, an aft end, and a longitudinal axis extending between the fore end and the aft end, a V-shaped portion extending from the fore end toward the aft end along a portion of the longitudinal axis, and an M-shaped portion extending from the V-shaped portion toward the aft end, wherein the V-shaped portion gradually transitions to the M-shaped portion; and a boat motor coupled to the hull.

What is claimed is:

1. A watercraft hull system, comprising:

a hull having a fore end, an aft end, and a longitudinal axis extending between the fore end and the aft end;

a V-shaped portion extending from the fore end toward the aft end along a portion of the longitudinal axis; and an M-shaped portion extending from the V-shaped portion toward the aft end, wherein the V-shaped portion gradually transitions to the M-shaped portion, wherein the hull includes a first starboard chine, a second starboard chine, a third starboard chine, a first port chine that extends from the first starboard chine at a centerline that runs along the longitudinal axis, a second port chine that extends from the second starboard chine at the centerline, and a third port chine that extends from the third starboard chine at the centerline, wherein the first starboard chine and the centerline define a first starboard side hull area, the first port chine and the centerline define a first port side hull area, the second starboard chine and the first starboard chine define a second starboard side hull area that extends starboard from the first starboard side hull area, the second port chine and the first port chine define a second port side hull area that extends port from the first port side hull area, the third starboard chine and the second starboard chine define a third starboard side hull area that extends starboard from the second starboard side hull area, and the third port chine and the second port chine define a third port side hull area that extends port from the second port side hull area, and wherein the second starboard side hull area and the second port side hull area have a positive deadrise in the V-shaped portion that gradually decreases in angle from the fore end to a zero degree angle at a furthest aft end of the V-shaped portion and have a negative deadrise in the M-shaped portion that gradually becomes more negative from the zero degree angle where the M-shaped portion is adjacent the V-shaped portion to a final negative angle.

2. The watercraft hull system of claim 1, wherein the centerline includes a keel having a stem and a forefoot.

3. The watercraft hull system of claim 2, wherein the first port chine and the first starboard chine meet at a first point on the stem, wherein the second port chine and the second starboard chine meet at a second point on the stem above the first point, and the third port chine and the third starboard chine meet at a third point on the stem above the first point and is nearest a sheerline of the hull.

4. The watercraft hull system of claim 3, wherein the second point and the third point are the same point.

5. The watercraft hull system of claim 1, wherein the second starboard side hull area is between the first starboard side hull area and the third starboard side hull area, and the second port side hull area is between the first port side hull area and the third port side hull area.

6. The watercraft hull system of claim 1, wherein the first starboard side hull area and the first port side hull area have positive deadrise from the fore end to the aft end.

7. The watercraft hull system of claim 1, wherein the third starboard side hull area and the third port side hull area have positive deadrise from the fore end to the aft end.

8. The watercraft hull system of claim 1, wherein the final negative angle is an angle between −10 degrees and −60 degrees.

9. The watercraft hull system of claim 1, wherein the final negative angle is realized at a point longitudinally in the M-shaped portion before the aft end, and the second starboard side hull area and the second port side hull area continue from the point to the aft end substantially at the final negative angle.

10. The watercraft hull system of claim 1, wherein the second starboard side hull area and the third starboard side hull area in the M-shaped portion form a starboard sponson, and the second port side hull area and the third port side hull area in the M-shaped portion form a port sponson.

11. The watercraft hull system of claim 10, wherein a transom extends substantially vertically from the first starboard side hull area and the first port side hull area at the aft end.

12. The watercraft hull system of claim 11, wherein the starboard sponson and the port sponson end further aft than the transom.

13. The watercraft hull system of claim 1, wherein the second starboard side hull area and the third starboard side hull area in the V-shaped portion and the M-shaped portion form a starboard sponson, and the second port side hull area and the third port side hull area in the V-shaped portion and the M-shaped portion form a port sponson.

14. The watercraft hull system of claim 1, wherein the second starboard side hull area has a latitudinal width of at least 8% of a beam of the hull in the M-shaped portion and the second port side hull area has a latitudinal width of at least 8% of the beam of the hull in the M-shaped portion.

15. The watercraft hull system of claim 14, wherein the first starboard side hull area has a latitudinal width of 20%-30% of the beam of the hull in the M-shaped portion and the first port side hull area has a latitudinal width of at least 20%-30% of the beam of the hull in the M-shaped portion.

16. The watercraft hull system of claim 1, wherein the V-shaped portion gradually transitions to the M-shaped portion by inverting a chine.

17. A boat, comprising:

a hull including a fore end, an aft end, and a longitudinal axis extending between the fore end and the aft end, a V-shaped portion extending from the fore end toward the aft end along a portion of the longitudinal axis, and a M-shaped portion extending from the V-shaped portion toward the aft end, wherein the V-shaped portion gradually transitions to the M-shaped portion, wherein the hull includes a first starboard chine, a second starboard chine, a third starboard chine, a first port chine that extends from the first starboard chine at a centerline that runs along the longitudinal axis, a second port chine that extends from the second starboard chine at the centerline, and a third port chine that extends from the third starboard chine at the centerline, and wherein the first starboard chine and the centerline define a first starboard side hull area, the first port chine and the centerline define a first port side hull area, the second starboard chine and the first starboard chine define a second starboard side hull area that extends starboard from the first starboard side hull area, the second port chine and the first port chine define a second port side hull area that extends port from the first port side hull area, the third starboard chine and the second starboard chine define a third starboard side hull area that extends starboard from the second starboard side hull area, and the third port chine and the second port chine define a third port side hull area that extends port from the second port side hull area, wherein the second starboard side hull area and the second port side hull area have a positive deadrise in the V-shaped portion that gradually decreases in angle from the fore end to a zero degree angle at a furthest aft end of the V-shaped portion and have a negative deadrise in the M-shaped portion that gradually becomes more negative from the zero degree angle where the M-shaped portion is adjacent the V-shaped portion to a final negative angle; and a motor coupled to the hull.

18. The boat of claim 17, wherein the centerline includes a keel having a stem and a forefoot.

19. The boat of claim 18, wherein the first port chine and the first starboard chine meet at a first point on the stem, wherein the second port chine and the second starboard chine meet at a second point on the stem above the first point, and the third port chine and the third starboard chine meet at a third point on the stem above the first point and is nearest a sheerline of the hull.

20. The boat of claim 17, wherein the second starboard side hull area is between the first starboard side hull area and the third starboard side hull area, and the second port side hull area is between the first port side hull area and the third port side hull area.

* * * * *